United States Patent [19]

Haber

[11] Patent Number: 4,823,966

[45] Date of Patent: Apr. 25, 1989

[54] TIERED COMPOTE TRAY

[75] Inventor: Robert H. Haber, Woodcliff Lake, N.J.

[73] Assignee: D. W. Haber & Son, Inc., Bronx, N.Y.

[21] Appl. No.: 84,826

[22] Filed: Aug. 13, 1987

[51] Int. Cl.[4] ..... A47F 3/14

[52] U.S. Cl. ..... 211/128; 211/78; 211/163

[58] Field of Search ..... 211/128, 131, 163, 41, 211/78, 129, 133, 71, 188; 108/101, 103; 248/146

[56] References Cited

U.S. PATENT DOCUMENTS

| | | | |
|---|---|---|---|
| 1,430,748 | 10/1922 | Nolte | 211/78 |
| 1,671,293 | 5/1928 | Jenneus | 211/163 X |
| 1,804,912 | 5/1931 | Anton | 211/78 |
| 3,498,471 | 3/1970 | Dirkx | 211/163 X |
| 3,543,699 | 12/1970 | Liekarts | 211/131 X |
| 3,782,296 | 1/1974 | Moretini | 211/128 X |
| 4,311,237 | 1/1982 | Hayes | 211/128 X |

FOREIGN PATENT DOCUMENTS

| | | | |
|---|---|---|---|
| 521764 | 3/1931 | Fed. Rep. of Germany | 211/77 |
| 407382 | 1/1910 | France | 211/163 |

*Primary Examiner*—J. Franklin Foss
*Assistant Examiner*—Sarah A. Lechok Eley
*Attorney, Agent, or Firm*—Charles E. Temko

[57] ABSTRACT

A heavy-duty tiered compote tray in which the tray supports are cantilevered laterally of a vertical supporting column to permit facilitated replacement of trays as required during use. Each tray is supported upon a rotating frame element, including a horizontally disposed ring member underlying the tray, and a hollow vertical column having both horizontally and vertically oriented bearing surfaces to facilitate orbital movement while supporting the trays. The device may be conveniently disassembled for periodic lubrication and intermediate storage, as required.

2 Claims, 2 Drawing Sheets

TIERED COMPOTE TRAY

BACKGROUND OF THE INVENTION

This invention relates generally to the field of food tray supporting means, and more particularly to an improved type tiered tray device particularly suited for commercial heavy duty service in hotels and banquet halls.

The typical tiered tray construction includes a vertical column upon which plural circular trays or dishes are coaxially aligned and penetrated by the column. The trays may be rotated on the column for convenient access to the contents thereof, and since the trays are supported at the geometrical center thereof, the entire construction may be of a relatively simple inexpensive nature.

The principal disadvantage of the above-described structure is that the trays cannot be individually removed to be replaced by full trays after the contents of the individual trays have been exhuasted. Where the device is in continuous use over an extended period of time, the trays will normally not be at empty condition at the same time, and the available selection to guests progressively diminishes until the entire device is ready for recharging.

In order to provide for the individual replacement of exhausted trays, it is necessary that the tray be individually removable from the device without disturbing the remaining trays. Further, in order to provide for ready accessibility of all of the trays positioned upon the device, each tray should be movable in a horizontal plane relative to the others.

SUMMARY OF THE INVENTION

Briefly stated, the invention contemplates the provision of an improved device of the above described class, in which the recited criteria are substantially met. To this end, the inventive structure contemplates a base element having means for supporting a lower tray in detachable association therewith. The base supports a vertically oriented rod. Engaging the rod and supported by the base is an intermediate support element supporting a second tray in relatively pivotal laterally extending orientation. A third or upper support element is arranged thereabove in similar fashion to be maintained by a nut member in threaded engagement with the upper end of the rod. Thus, each of the intermediate support elements and upper support element is capable of orbital movement relative to the vertically extending rod.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 2:
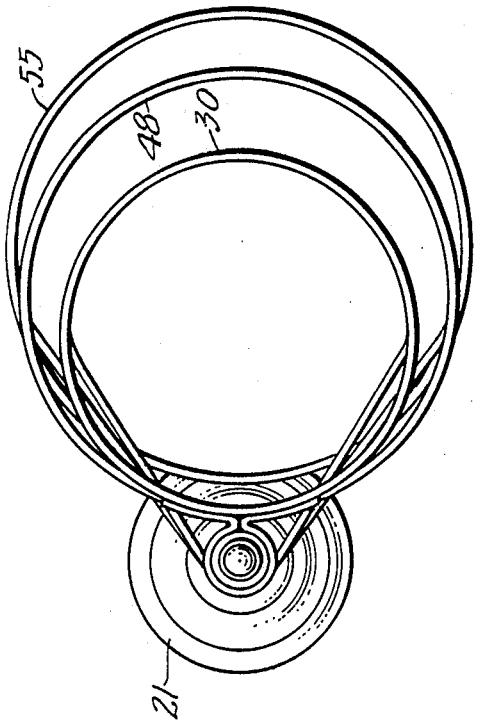
FIG. 2 is a top plan view of an intermediate support element forming part of the disclosed embodiment.
Figure 3:
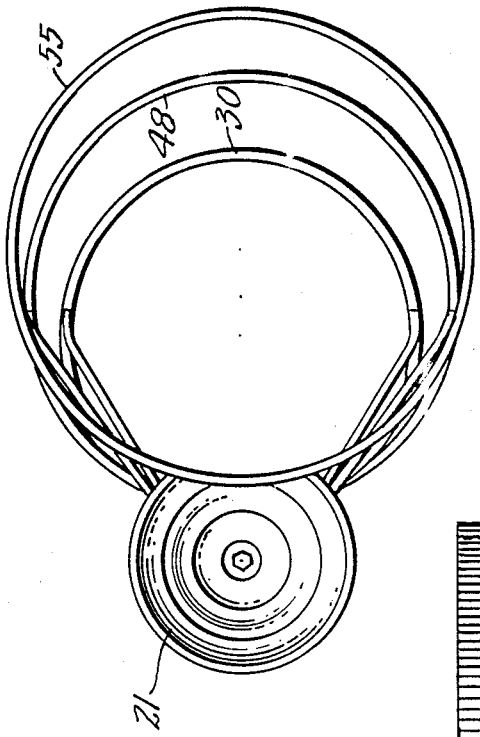
FIG. 3 is a bottom plan view of an upper support element forming another part of the disclosed embodiment.
Figure 1:
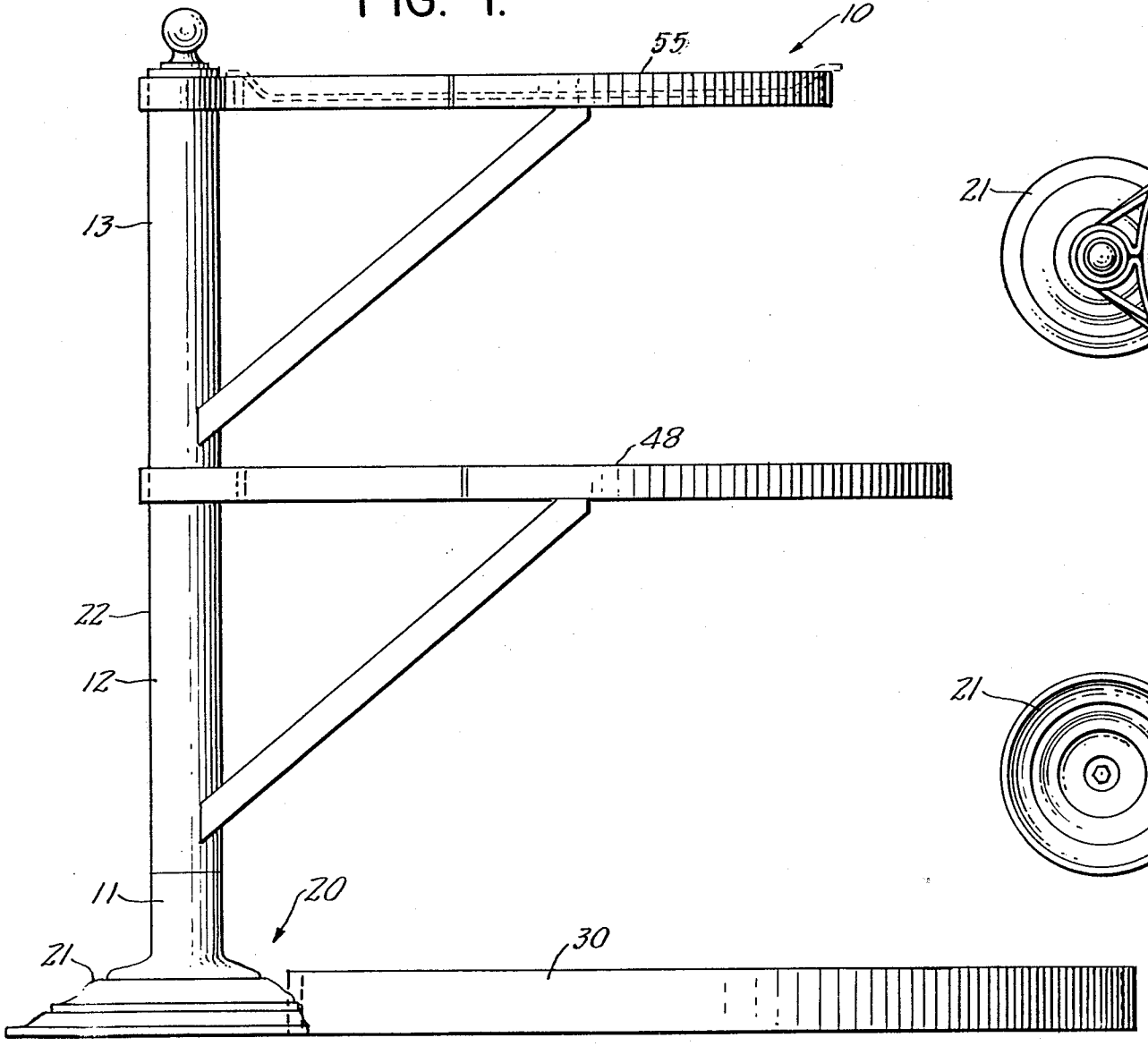
FIG. 1 is a side elevational view of an embodiment of the invention in fully assembled condition.
Figure 4:
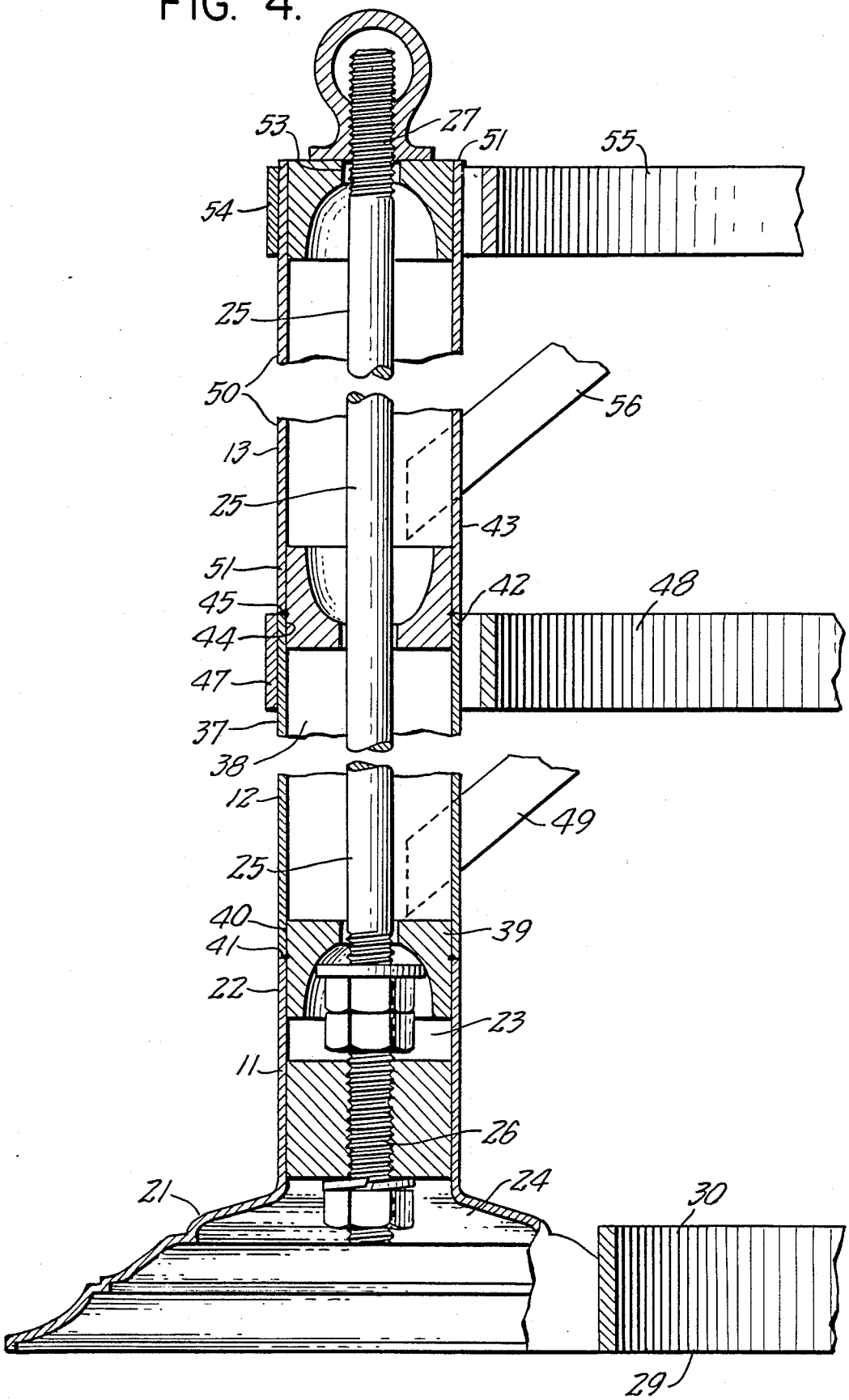
FIG. 4 is a longitudinal fragmentary sectional view of a base support element.

In accordance with the invention, the device, generally indicated by reference character 10, comprises broadly: a base support element 11, an intermediate support element 12, and an upper support element 13.

The base support element 11 is preferably formed from welded steel construction, and includes a circular pedestal or base housing 20 having a generally conical member 21 supporting a vertical tubular member 22 forming a circular socket 23. Projecting through the socket 23 in a generally cylindrical recess 24 is a vertically oriented threaded rod 25, a lower end 26 thereof being engaged within the socket 23, and an upper end 27 having corresponding threads thereon. Laterally extending from the member 21 is a tray-supporting ring, preferably welded thereto, having a lower surface 29 which is coplanar with that of the member 21, designated by reference character 30.

The intermediate support element 12 includes a vertically oriented sleeve 37 having a central bore 38 surrounding the rod 25. The sleeve is provided with a lower bearing extension 39 which engages the socket 23. The extension 39 includes a cylindrical surface 40 and a transverse bearing shoulder 41. At an upper end 42 thereof is a similar sleeve 43 having a cylindrical surface 44 and a horizontal bearing surface 45. At an upper end 46 is a curvilinear bracket 47 welded to the sleeve, in turn welded to a tray-supporting ring 48, the diameter of which may be slightly smaller than that of the ring 28. The ring is maintained in a horizontal condition by a pair of reinforcing struts 49.

The upper support element 13 is similar, and includes a vertical tubular sleeve 50, a lower end 51 of which engages the suppport element 12, and an upper end 52 of which is provided with an opening 53 through which the upper end of the rod 25 projects.

A similar curvilinear bracket 54 extends laterally from the axis of the rod, and is welded to a tray support ring 55 of still smaller diameter. The ring 55 is supported by reinforcing struts 56.

The rings are adapted to support conventional serving platters for dishes (57) which can be manually placed upon the rings, or removed as desired.

In use, the device is preferably fully assembled before placing upon a banquet table or similar supporting surface, and the relative position of the support elements 11 and 13 adjusted within parallel horizontal planes. Next, the trays (not shown) may be placed to be supported by the respective tray-supporting rings, and the device placed in service. As each tray becomes emptied, or nearly emptied, it may be separately removed by service personnel tô be replaced by a full tray, as required.

I wish it to be understood that I do not consider the invention to be limited to the precise details of structure shown and set forth in this specification, for obvious modifications will occur to those skilled in t e art to which the invention pertains.

I claim:

1. An improved tiered tray construction comprising: a base element, an intermediate support element and an upper support element, said elements being in mutually pivotal stacked relationship, said base element including a generally horizontally oriented base member, a cylindrical socket member extending vertically therefrom, and a tray supporting ring extending laterally therefrom, said socket member having a vertically oriented rod extending therefrom; said intermediate support element having a vertically oriented tubular sleeve pivotally engaging said rod and supported by said base element and having a laterally extending tray-supporting ring thereon at least partially overlying said tray-supporting ring on said base support element; said upper support element including a vertical elongated sleeve pivotally engaged upon said rod, and supported by said intermediate support element at a lower end thereof, said sleeve mounting a laterally extending tray supporting ring at least partially overlying said tray supporting ring of said intermediate support element; and means engaging said rod at an upper end thereof, and maintaining intermediate and upper support elements in mutual pivotal association.

2. An improved tray construction in accordance with claim 1, further characterized in said tray supporting rings being of progressively smaller diameter in an upward direction.

* * * * *